US008270631B2

(12) United States Patent
Kusunoki

(10) Patent No.: US 8,270,631 B2
(45) Date of Patent: Sep. 18, 2012

(54) MULTI-CHANNEL AUDIO AMPLIFICATION APPARATUS

(75) Inventor: Miwa Kusunoki, Neyagawa (JP)

(73) Assignee: Onkyo Corporation, Osaka (JP)

( * ) Notice: Subject to any disclaimer, the term of this patent is extended or adjusted under 35 U.S.C. 154(b) by 1452 days.

(21) Appl. No.: 11/829,144

(22) Filed: Jul. 27, 2007

(65) Prior Publication Data

US 2008/0063211 A1 Mar. 13, 2008

(30) Foreign Application Priority Data

Sep. 12, 2006 (JP) ..... 2006-246914

(51) Int. Cl.
*H04R 27/00* (2006.01)

(52) U.S. Cl. ..... 381/85; 381/81; 381/120; 381/123; 381/58; 381/59

(58) Field of Classification Search ..... 381/1, 17, 381/58–59, 95, 96, 123, 300, 307, 81, 85, 381/120

See application file for complete search history.

(56) References Cited

U.S. PATENT DOCUMENTS

| | | | | |
|---|---|---|---|---|
| 5,182,552 | A * | 1/1993 | Paynting | 340/4.42 |
| 5,287,547 | A * | 2/1994 | Hidaka | 455/3.04 |
| 6,430,353 | B1 * | 8/2002 | Honda et al. | 386/234 |
| 6,655,212 | B2 * | 12/2003 | Ohta | 73/586 |
| 6,901,148 | B2 * | 5/2005 | Yoshino et al. | 381/103 |
| 7,006,645 | B2 * | 2/2006 | Fujita et al. | 381/307 |
| 7,054,448 | B2 * | 5/2006 | Yoshino et al. | 381/59 |
| 7,146,018 | B2 * | 12/2006 | Tamayama | 381/300 |
| 7,412,067 | B2 * | 8/2008 | Koyama | 381/307 |
| 2001/0016045 | A1 * | 8/2001 | Ohta | 381/98 |
| 2001/0038702 | A1 * | 11/2001 | Lavoie et al. | 381/307 |
| 2002/0159603 | A1 * | 10/2002 | Hirai et al. | 381/61 |
| 2004/0062402 | A1 * | 4/2004 | Fujita et al. | 381/18 |
| 2004/0258259 | A1 * | 12/2004 | Koyama | 381/307 |
| 2005/0152557 | A1 * | 7/2005 | Sasaki et al. | 381/58 |
| 2005/0175195 | A1 * | 8/2005 | Cheney, Jr. et al. | 381/120 |
| 2006/0062397 | A1 * | 3/2006 | Cooper | 381/58 |
| 2006/0062399 | A1 * | 3/2006 | Cooper et al. | 381/58 |
| 2006/0083393 | A1 * | 4/2006 | Richenstein et al. | 381/302 |
| 2007/0242832 | A1 * | 10/2007 | Matsumoto et al. | 381/2 |

FOREIGN PATENT DOCUMENTS

| | | |
|---|---|---|
| JP | 11-243599 | 9/1999 |
| JP | 2003-032800 | 1/2003 |
| JP | 2004-056418 | 2/2004 |

* cited by examiner

*Primary Examiner* — Goins Davetta
*Assistant Examiner* — Disler Paul
(74) *Attorney, Agent, or Firm* — Renner, Otto, Boisselle & Sklar, LLP

(57) ABSTRACT

There is provided a multichannel audio amplification apparatus including a speaker detection circuit for detecting whether or not a speaker is connected to an arbitrary speaker terminal of speaker terminal groups TA and TB, and an operating circuit and a display circuit connected to a control circuit. Even in a case where one of two speaker groups of A and B types connected to the multichannel audio amplification apparatus cannot be connected with a surround speaker for reproducing only a surround sound, a listener is prevented, by indication, from carrying out on the operating circuit an erroneous operation or setting which otherwise might be liable to occur both in a case where the B-type speaker group including no surround speaker is connected to the multichannel audio amplification apparatus and in a case where the B-type speaker group is not connected thereto.

13 Claims, 7 Drawing Sheets

(a)

(b)

(a)

(b)

(a)

(b)

(a)

(b)

MULTI-CHANNEL AUDIO AMPLIFICATION APPARATUS

BACKGROUND OF THE INVENTION

1. Field of the Invention

This invention relates to a multichannel audio amplification apparatus for reproducing a multichannel sound including a surround sound, and in particular to a multichannel audio amplification apparatus including a speaker terminal group TA for connecting an A-type speaker group including a surround speaker for reproducing only the surround sound and a speaker terminal group TB for connecting a B-type speaker group including no surround speaker.

2. Description of the Related Art

There is provided a multichannel audio amplification apparatus for reproducing a surround sound field by reproducing what is called a multichannel audio signal having a plurality of independent audio signal channels alone or with a video signal. With regard to the multichannel audio signal, various systems and formats have been proposed including directions of arranging speakers for respective channels, reproduction frequency bands and surround systems. In many cases, the multichannel audio signal may include totally five channels of signals having a front center signal C, a surround left signal SL and a surround right signal SR as well as a front left signal L and a front right signal R, or may include totally seven channels of signals further having a surround back left signal SBL and a surround back right signal SBR. Also, the multichannel audio signal may include what is called 5.1 channels or 7.1 channels of signals additionally having a bass signal LFE.

The multichannel sound is expected to be reproduced by a speaker group including a plurality of speakers connected to the multichannel audio amplification apparatus and arranged correspondingly to the respective channels. Front audio signals (including the front left signal L, the front right signal R and the front center signal C, as in all the cases described below) are reproduced by front speakers (including a front left speaker Lsp, a front right speaker Rsp and a front center speaker Csp, as in all the cases described below) arranged in front of a listener. Further, surround audio signals (including the surround left signal SL, the surround right signal SR, the surround back left signal SBL and the surround back right signal SBR, as in all the cases described below) are desirably reproduced by the surround speakers (including a surround left speaker SLsp, a surround right speaker SRsp, a surround back left speaker SBLsp and a surround back right speaker SBRsp, as in all the cases described below) respectively arranged on a side or behind the listener.

Assume the speaker group for reproducing the multichannel sound has a minimum configuration including only the front speakers arranged in front of the listener and no surround speaker for reproducing only the surround audio signal, specifically including only the front left speaker Lsp and the front right speaker Rsp for ordinary stereo reproduction. In such a case, the multichannel audio amplification apparatus generates a stereo audio signal obtained by mixing the surround audio signal into the front audio signal, which stereo audio signal is reproduced by the front speakers. Such a process of generating the stereo audio signal includes a down-mixing process (including a simple phase shift process and the like) of adding the surround audio signal to the front audio signal, and what is called a virtual surround process of adding an audio signal obtained by subjecting the surround audio signal to a virtual localization process based on the HRTF (Head Related Transfer Function) to the front audio signal.

Incidentally, unless the stereo audio signal is generated by mixing the surround audio signal with the front audio signal, a problem would be posed that the surround audio signal cannot be reproduced by the front left speaker Lsp and the front right speaker Rsp.

Conventionally, two speaker groups including A and B types are connected to a single multichannel audio amplification apparatus, and one of the speaker groups of A and B types is used by switching therebetween (what is called "Speaker A or B"), or the speaker groups of A and B types are used simultaneously (what is called "Speaker A+B"). The A-type speaker group and the B-type speaker group are used by being arranged in an identical or different zones (an area such as one room, or an area for reproduction). In the most common method of use, the listener arranges the A-type speaker group in a first zone and the B-type speaker group in a second zone, so that, in a case where the multichannel sound is reproduced in the first zone, the multichannel audio amplification apparatus can be operated to output to the A-type speaker group while, in a case where the multichannel sound is reproduced in the second zone, the multichannel audio amplification apparatus can be operated to output to the B-type speaker group.

However, all the multichannel audio amplification apparatuses are not necessarily so configured that the surround speaker for reproducing only the surround sound can be connected to each of the two speaker groups of A and B types. Speaker terminals for connecting the front speakers and the surround speakers can be prepared for the speaker terminal group TA for connecting the A-type speaker group. For the speaker terminal group TB for connecting the B-type speaker group, on the other hand, only speaker terminals for connecting the front left speaker Lsp and the front right speaker Rsp for ordinary stereo reproduction may be prepared due to a limited space of a panel for installing the speaker terminals.

A conventional speaker connection circuit apparatus (Japanese Patent Publication for opposition No. 2003-32800) is available, including a speaker drive means for self-determining connection or non-connection of a speaker, a means for automatically changing a down-mix method based on the number of speakers connected and a multichannel audio system to be reproduced, and an amplification means for carrying out a predetermined down-mixing based on the number of speakers connected and the multichannel audio system to be reproduced and driving the speakers. Also, there is also conventionally available a sound reproduction apparatus (Japanese Patent Publication for opposition No. 2004-56418) including a mode setting means adapted to select one of a first mode with the A-type speaker group and the B-type speaker group arranged in the first zone and a second mode with the A-type speaker group arranged in the first zone and the B-type speaker group in the second zone. Also, there is available an apparatus having a set-up device (Japanese Patent Publication for opposition No. 11-243599) for, in order to detect the speakers connected to the multichannel audio amplification apparatus and specify setting conditions for each channel, inputting a test signal to the connected speaker and measuring a test sound reproduced by the test signal with a microphone to set a level and delay time.

In these conventional multichannel audio amplification apparatuses, assume that the listener operates to use the B-type speaker group including no surround speaker (for example, operation to turn on "speaker B"). Unless the process (hereinafter referred to a the mixing process) is executed to generate the stereo audio signal by mixing the surround audio signal with the front audio signal as described above, no surround audio signal component is reproduced by the B-type speaker group. Therefore, the mixing process is executed without regard to the configuration of the A-type speaker group connected. In a case where the listener operates the speaker configuration of the multichannel audio amplification apparatus to turn on the "speakers A+B", therefore, the stereo audio signal subjected to the mixing process is reproduced by the front speakers in the zone with the A-type speaker group arranged therein and the surround speaker in the A-type speaker group cannot be used even when the A-type speaker group has the surround speaker.

Also, in some multichannel audio amplification apparatuses, a part of the terminals of the speaker terminal group TA occasionally double as those of the speaker terminal group TB for cost reduction. In this multichannel audio amplification apparatus, an operation for "speaker B setting" in a set-up menu is required. Specifically, the set-up menu includes "speaker B setting" for permitting the listener to preliminarily set by distinguishing whether the shared speaker terminal is connected with "the surround speaker of the A-type speaker group" or "the front speaker of the B-type speaker group". In a case where the "speaker B setting" is on, for example, "the speaker B" but not "the surround speaker of the A-type speaker group" is connected to "the surround speaker terminal", and the mixing process may be automatically set in spite of use of the A-type and/or B-type speaker groups.

Nevertheless, the listener not accustomed to the multichannel audio amplification apparatus may erroneously operate to "use the B-type speaker group", resulting in that the listener may erroneously recognize a malfunction that "no surround sound is reproduced by the surround speaker of the A-type speaker group". In such a case, even if the A-type speaker group has the surround speaker, the stereo audio signal subjected to the mixing process is reproduced by the front speakers and therefore no surround sound is reproduced by the surround speaker of the A-type speaker group in the zone with the A-type speaker group arranged therein. In the operation of the multichannel audio amplification apparatus, this may lead to misrecognition by the listener as a malfunction that "only the mixing process can be selected". In a case where "the speaker B setting" is erroneously turned on, on the other hand, the listener may take it as a malfunction that "the front sound is reproduced by the surround speaker (of the A-type speaker group connected to the speaker terminal group TB which is shared as a matter of fact)".

Specifically, assume that the listener erroneously operates or sets the multichannel audio amplification apparatus due to a fact that one of the two speaker groups of A and B types connected to the multichannel audio amplification apparatus cannot be connected with the surround speaker for reproducing only the surround sound. Then, the multichannel audio signal is required to be subjected to the mixing process substantially forcibly, thereby posing a problem that the misrecognition that the multichannel audio amplification apparatus malfunctions may occur to the listener. Also, provision of the mode setting means or the like gives rise to a problem that the setting operation of the multichannel audio amplification apparatus is complicated.

SUMMARY OF THE INVENTION

This invention has been achieved to solve the aforementioned problems of the conventional art, and an object thereof is to provide a multichannel audio amplification apparatus wherein even in a case where one of two speaker groups of A and B types connected to the multichannel audio amplification apparatus cannot be connected with a surround speaker for reproducing only a surround sound, the listener rarely operates or sets erroneously the multichannel audio amplification apparatus and misrecognition as a malfunction hardly occurs.

According to this invention, there is provided a multichannel audio amplification apparatus including a speaker terminal group TA for connecting an A-type speaker group including a surround speakers for reproducing only a surround sound included in a multichannel sound and a speaker terminal group TB for connecting a B-type speaker group including no surround speaker; the multichannel audio amplification apparatus further including: an audio output circuit for outputting one of a multichannel audio signal and a stereo audio signal obtained by the multichannel audio signal subjected to a mixing process; an amplifier circuit including a plurality of amplifiers for amplifying one of the multichannel audio signal and the stereo audio signal; a selective output circuit for selectively outputting one of the amplified multichannel audio signal and the amplified stereo audio signal by switching to an arbitrary speaker terminal out of the speaker terminal groups TA and TB; a speaker detection circuit for detecting whether or not a speaker is connected to an arbitrary speaker terminal out of the speaker terminal groups TA and TB; a control circuit for controlling the audio output circuit, the amplifier circuit, the selective output circuit and the speaker detection circuit; and an operating circuit and a display circuit connected to the control circuit; wherein in a case where the speaker detection circuit detects that no speaker is connected to one of the speaker terminals of the speaker terminal group TB, the control circuit controls the audio output circuit and the selective output circuit in such a manner that output signals of the plurality of amplifiers are output to none of the speaker terminals of the speaker terminal group TB, and controls the display circuit to display that an operation for using the B-type speaker group by the operating circuit is impossible, while in a case where the speaker detection circuit detects that the speaker is connected to one of the speaker terminals of the speaker terminal group TB, the control circuit controls the display circuit to display that the operation for using the B-type speaker group by the operating circuit is possible.

More preferably, in the multichannel audio amplification apparatus, the speaker detection circuit includes: a first detection circuit having a first test signal output circuit for selectively outputting a noise signal to an arbitrary speaker terminal out of the speaker terminal groups TA and TB, and a mic amplifier connected with a microphone for converting a sound wave in an installation zone into an electrical signal and outputting a first detection signal, the first detection circuit being adapted to detect that the speaker is connected to an arbitrary speaker terminal out of the speaker terminal groups TA and TB upon detection of the first detection signal correlated with the noise signal; and a second detection circuit having a second test signal output circuit for selectively outputting a fine DC signal to an arbitrary speaker terminal of the speaker terminal group TB and an offset detection circuit for detecting a DC voltage of the speaker terminal to convert into a second detection signal, the second detection circuit being adapted to detect that the speaker is connected to an arbitrary speaker terminal of the speaker terminal group TB upon detection of the second detection signal correlated with the fine DC signal.

Also, preferably, in the multichannel audio amplification apparatus, the speaker terminal group TB for connecting the B-type speaker group is set to double as a surround speaker terminal group for connecting the surround speakers in the A-type speaker group included in the speaker terminal group TA.

Preferably, in the multichannel audio amplification apparatus, in a case where the speaker detection circuit detects that the speaker is connected to one of the speaker terminals of the speaker terminal group TB and the operating circuit is operated to use only the A-type speaker group, the control circuit controls the audio output circuit to output the multichannel audio signal and controls the selective output circuit to output the output signals from the plurality of amplifiers only to the speaker terminals of the speaker terminal group TA.

Preferably, in the multichannel audio amplification apparatus, in a case where the speaker detection circuit detects that the speaker is connected to one of the speaker terminals of the speaker terminal group TB and the operating circuit is operated to use only the B-type speaker group, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal group TB.

Preferably, in the multichannel audio amplification apparatus, in a case where the speaker detection circuit detects that the speaker is connected to one of the speaker terminals of the speaker terminal group TB and the operating circuit is operated to use the A-type speaker group and the B-type speaker group simultaneously, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal groups TA and TB.

Preferably, in the multichannel audio amplification apparatus, in a case where the first detection circuit of the speaker detection circuit does not detect that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in different zones, and controls the audio output circuit to output the stereo audio signal obtained from the multichannel audio signal subjected to the mixing process and controls the selective output circuit to output the output signals from the plurality of amplifiers to the speaker terminals of the speaker terminal group TB.

Preferably, in the multichannel audio amplification apparatus, in a case where the first detection circuit of the speaker detection circuit detects that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in an identical zone, and controls the audio output circuit, the amplifier circuit, the selective output circuit, the operating circuit and the display circuit, and in a case where the control circuit determines that a spatial distance Da between the speaker terminal group TA detected by the first detection circuit and the microphone is extremely different from a spatial distance Db between the speaker terminal group TB detected by the first detection circuit and the microphone, the control circuit controls the audio output circuit to output the stereo audio signal obtained from the multichannel audio signal subjected to the mixing process and controls the selective output circuit to output the output signals from the plurality of amplifiers to the speaker terminals of the speaker terminal group TB.

Now, operations of the invention are explained.

The multichannel audio amplification apparatus according to the invention includes the speaker terminal group TA for connecting the A-type speaker group including the surround speaker for reproducing only the surround sound out of the multichannel sound, and the speaker terminal group TB for connecting the B-type speaker group including no surround speaker. In a case where the B-type speaker group including no surround speaker is used, therefore, the control circuit controls the audio output circuit to output the stereo audio signal obtained from the multichannel audio signal subjected to the mixing process. The amplifier circuit and the selective output circuit respectively amplify the stereo audio signal and selectively output by switching the output signals of the amplifiers to the speaker terminals of the speaker terminal group TB. This is also true in a case where the speaker terminal group TB is set to double as the surround speaker terminal group for connecting the surround speakers included in the A-type speaker group out of the speaker terminal group TA.

The multichannel audio amplification apparatus according to the invention includes the speaker detection circuit for detecting whether or not the speaker is connected to an arbitrary speaker terminal out of the speaker terminal groups TA and TB. Specifically, this speaker detection circuit includes the first detection circuit and the second detection circuit. The first detection circuit selectively outputs the noise signal to an arbitrary speaker terminal out of the speaker terminal groups TA and TB, and connects the microphone for converting the sound wave of the installation zone to the electrical signal to detect that the speaker is connected to the speaker terminal. Also, the second detection circuit selectively outputs the fine DC signal to an arbitrary speaker terminal of the speaker terminal group TB, and, by detecting the DC voltage of the speaker terminal, detects that the speaker is connected to the speaker terminal. Thus, the multichannel audio amplification apparatus can positively detect whether or not the speaker is connected to one of the speaker terminals of the speaker terminal group TB, and further can determine whether the A-type speaker group and the B-type speaker group are arranged in an identical zone or different zones.

Specifically, the multichannel audio amplification apparatus according to the invention includes the operating circuit and the display circuit connected to the control circuit, and therefore, can display to prevent an erroneous operation or setting often caused by the listener on the operating circuit both in a case where the B-type speaker group including no surround speaker is connected and in a case where the B-type speaker group is not connected. As a result, misrecognition in terms of a malfunction can be prevented. In a case where the speaker detection circuit detects that the speaker is not connected to any of the speaker terminals of the speaker terminal group TB, the display circuit is controlled to display that the operation for using the B-type speaker group on the operating circuit is impossible, while in a case where the speaker detection circuit detects that the speaker is connected to one of the speaker terminals of the speaker terminal group TB, the display circuit is controlled to display that the operation for using the B-type speaker group is possible on the operating circuit.

Also, in a case where the speaker detection circuit detects that the speaker is not connected to any of the speaker terminals of the speaker terminal group B, the control circuit controls the audio output signal and the selective output circuit not to output the output signals of the plurality of amplifiers to any of the speaker terminals of the speaker terminal group TB. Further, in a case where the speaker detection circuit detects that the speaker is connected to one of the speaker terminals of the speaker terminal group TB, the control circuit controls the audio output circuit, the amplifier circuit, and the selective output circuit in accordance with the operation on the operating circuit to use only the A-type speaker group, only the B-type speaker group, or both the A- and B-type speaker groups simultaneously.

In a case where the speaker detection circuit detects that the speaker is connected to one of the speaker terminals of the speaker terminal group TB and the operating circuit is operated to use only the B-type speaker group, for example, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal group TB. Specifically, as long as the speaker is connected to one of the speaker terminals of the speaker terminal group TB, the operation of "Use B-type speaker group" or "Speaker B setting" can be selected from the set-up menu, resulting in that the stereo sound obtained by subjecting the multichannel sound to the mixing process can be reproduced by the B-type speakers connected to the speaker terminal group TB.

Also, in the multichannel audio amplification apparatus according to the invention, since the speaker detection circuit includes the first detection circuit and the second detection circuit, it is possible to determine whether the A-type speaker group and the B-type speaker group are arranged in an identical zone or different zones, and further, in a case where the A-type speaker group and the B-type speaker group are arranged in the identical zone, the first detection circuit can determine the spatial distance Da between the speaker terminal group TA and the microphone as well as the spatial distance Db between the speaker terminal group TB and the microphone.

In a case where the first detection circuit does not detect that the B-type speaker group is connected to the speaker terminal group TB, and the second detection circuit detects that the B-type speaker group is connected to the speaker terminal group TB, for example, it is highly probable that the microphone connected to the first detection circuit and the B-type speaker group are arranged in different zones. Thus, the control circuit of the multichannel audio amplification apparatus can determine that "the A-type speaker group is arranged in the first zone and the B-type speaker group in the second zone" assumed as a method of use most widely employed. As a result, unlike in the conventional art, necessity is eliminated to additionally provide the mode setting means capable of selecting one of the first mode of arranging the A-type speaker group and the B-type speaker group in the first zone and the second mode of arranging the A-type speaker group in the first zone and the B-type speaker group in the second zone, thereby simplifying setting operation of the multichannel audio amplification apparatus.

The multichannel audio amplification apparatus according to the invention realizes that, even in a case where one of the two speaker groups of A and B types connected to the multichannel audio amplification apparatus cannot be connected with the surround speaker for reproducing only the surround sound, operation is simple for the listener and an erroneous operation or setting is rarely made, while substantially preventing misrecognition of a malfunction.

DETAILED DESCRIPTION OF THE PREFERRED EMBODIMENTS

Preferred embodiments of the invention are explained specifically below with reference to the drawings, although the invention is not limited to these embodiments.

First Embodiment

Figure 1:
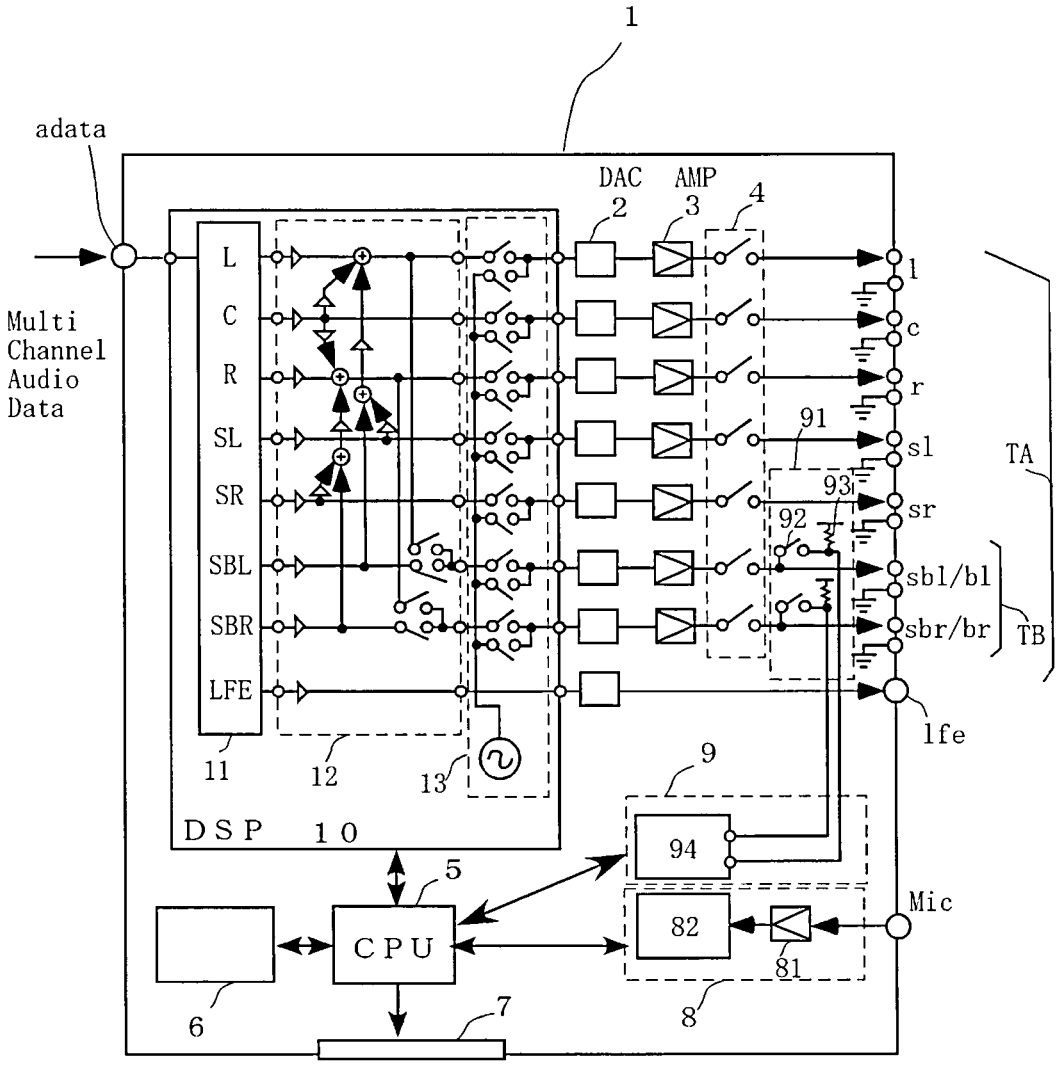
FIG. 1 is a diagram for explaining a multichannel audio amplification apparatus (First Embodiment)

FIG. 1 is a diagram for explaining a multichannel audio amplification apparatus 1 according to a preferred embodiment of the invention. The multichannel audio amplification apparatus 1 decodes multichannel audio data input to a terminal adata from a DVD player or the like (not shown), amplifies for each channel, outputs to a plurality of speakers (not shown) connected to a speaker terminal group TA, and thus reproduces a multichannel sound for a listener U. The multichannel audio amplification apparatus 1 includes the speaker terminal group TA for connecting an A-type speaker group including a surround speaker for reproducing only a surround sound out of the multichannel sound, and a speaker terminal group TB for connecting the B-type speaker group including no surround speaker, wherein the speaker terminal group TB doubles as a part of the speaker terminal group TA. The multichannel audio amplification apparatus 1, therefore, may execute a mixing process on a multichannel audio signal in accordance with a speaker connected to the speaker terminal.

In the multichannel audio amplification apparatus 1 according to this embodiment, a decode circuit 11 built in a DSP (Digital Signal Processor) 10 decodes the multichannel audio data into 7.1-channel surround audio data. The 7.1-channel audio data includes a total of 7 channels of all band components including front left data L, front right data R, front center data C, surround left data SL, surround right data SR, surround back left data SBL, and surround back right data SBR, as well as band-limited bass data LFE. The 7.1-channel audio data is output to DACs (Digital Analog Converter) 2 through a mix processing circuit 12 built in the DSP 10, and converted into a 7.1-channel analog audio signal. A total of 7 channels of all the band components in the 7.1-channel analog audio signal are amplified by amplifiers 3 for amplifying respective channel sounds, and through a select circuit 4 including a plurality of switch relays, are output to the speaker terminal group TA. Also, a band-limited bass signal LFE is output from a terminal lfe and input to a subwoofer Sub (not shown) built in the amplifier.

Also, the multichannel audio amplification apparatus 1 includes a CPU (central Processing Unit) 5 for controlling the entire apparatus, an operating circuit 6 including a switch and the like, a display circuit 7 including a liquid crystal display panel and a LED, a speaker identification circuit 8 for connecting a microphone, and a connection detecting circuit 9 for detecting that a speaker is connected to the speaker terminal of the speaker terminal group TB. Remaining parts of the circuit configuration including a power supply are not shown in FIG. 1. The operating circuit 6 and the display circuit 7 of the multichannel audio amplification apparatus 1 enable an operation "Speaker B setting" or an operation for using by switching between the A-type speaker group and the B-type speaker group (including "Speaker A or B" (including on/off operations of either one of "Speaker A" or "Speaker B"), and an operation of selecting "Speaker A+B"), and a setting and an operation for switching between the first zone and the second zone in the set-up menu. The speaker detection circuit for detecting whether or not the speakers are connected to the speaker terminal groups TA and TB includes the CPU 5, the DSP 10, the speaker identification circuit 8 and the connection detecting circuit 9.

Due to respective installation conditions, the plurality of speakers for multichannel reproduction have different acoustic conditions (difference in delay time due to difference in spatial distance, and difference in reproduction level) at a listening position of the listener U. The CPU 5 of the multichannel audio amplification apparatus 1 respectively measures the acoustic conditions of the plurality of speakers at the listening position of the listener U using the microphones connected, and automatically corrects a sound field by adjusting the delay time and the reproduction level in such a manner as to reflect and place measurement results in order. A first test signal output circuit 13 built in the DSP 10 selectively outputs a test noise signal to each channel through the switch. The test noise signal is amplified by the amplifiers 3, and through the select circuit 4 and the speaker terminals of the speaker terminal groups TA and TB, is supplied to each speaker for reproduction.

The speaker identification circuit 8 includes a mic amplifier 81 and a first detection circuit 82. The mic amplifier 81 is connected with the microphone for converting a sound wave in an installation zone into an electrical signal, and outputs a first detection signal. The first detection circuit 82 detects that the speaker is connected upon detection of the first detection signal correlated with the test noise signal. For each speaker connected to the speaker terminal groups TA and TB, the CPU 5 measures, using the speaker identification circuit 8, the delay time caused by the spatial distance from the microphone and the reproduction level. In a case where the first detection signal is not detected, the first detection circuit 82 detects that the speaker is not connected to the speaker terminal supplied with the test noise signal.

The connection detecting circuit 9 included in the speaker detection circuit, on the other hand, detects whether or not the speakers are connected to the speaker terminal group TB. In a case where the switch relays 92 in the select circuit 4 are turned on from an off state thereof by a second test signal output circuit 91 of the connection detecting circuit 9, the speaker terminals of the speaker terminal group TB are impressed with a fine DC voltage through pull-up resistors 93. As long as the speaker is connected, a fine DC current is detected at the speaker terminal of the speaker terminal group TB. Therefore, the second detection circuit 94 including the offset detection circuit, upon detection of a second detection signal correlated with the fine DC signal, detects that the speaker is connected to the speaker terminal group TB, and upon failure to detect the second detection signal correlated with the fine DC signal, the second detection circuit 94 detects that the speaker is not connected to the speaker terminal group TB.

Specifically, the CPU 5 for controlling the multichannel audio amplification apparatus 1 detects presence or absence of the speakers connected to the speaker terminal groups TA and TB, and presence or absence of the speakers connected to the speaker terminal group TB. The CPU 5, therefore, based on a detection result, operates in such a manner that the listener U may not erroneously operate or set the multichannel audio amplification apparatus 1. Such operation is described in detail later.

In this embodiment, the speaker terminal group TA of the multichannel audio amplification apparatus 1 includes a speaker terminal group for connecting a total of 7-channel speakers including a terminal 1 for connecting a front left speaker Lsp, a terminal c for connecting a front center speaker Csp, a terminal r for connecting a front right speaker Rsp, a terminal sl for connecting a surround left speaker SLsp, a terminal sr for connecting a surround right speaker SRsp, a terminal sbl for connecting a surround back left speaker SBLsp, and a terminal sbr for connecting a surround back right speaker SBRsp. Thus, a maximum of seven speakers of the A-type speaker group can be connected to all the 7-channel speaker terminals of the speaker terminal group TA.

Also, the terminals sbl and sbr constituting a part of the speaker terminal group TA double as the speaker terminal group TB for connecting the B-type speaker terminal group (a front left speaker LspB and a front right speaker RspB) including no surround speaker, and the terminals are respectively expressed as the terminal sbl/bl and the terminal sbr/br. The listener U, when turning on (valid) "Speaker B setting" of the multichannel audio amplification apparatus 1 according to this embodiment and intending to use the B-type speaker group by further turning on the "Speaker B" with the switch of the operating circuit 6, connects the B-type front left speaker LspB to the terminal sbl/bl and the B-type front right speaker RspB to the terminal sbr/br. In this case, the stereo audio signal obtained from the multichannel audio signal subjected to the mixing process is output from the terminals sbl/bl and sbr/br.

Figure 2:
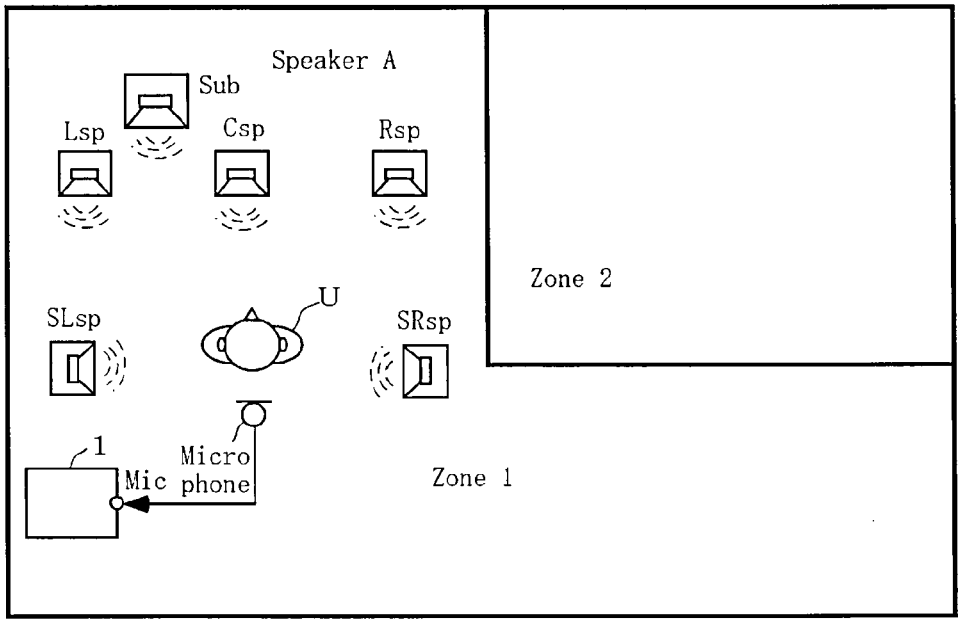
FIG. 2 is a diagram for explaining typical operation of the multichannel audio amplification apparatus (First Embodiment)
Figure 2:
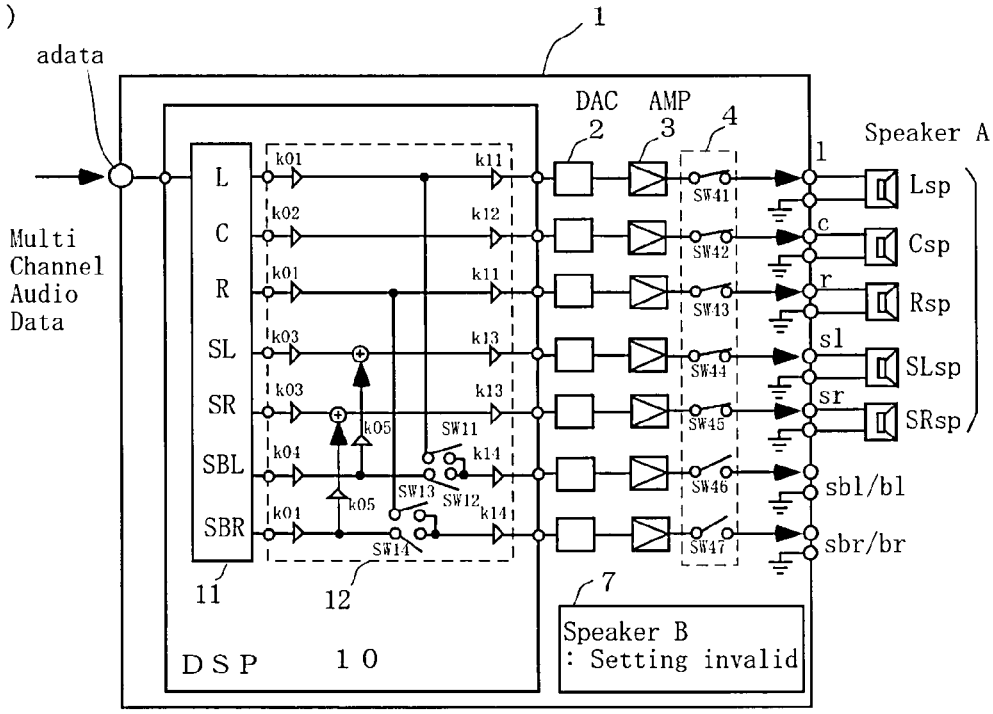

As described above, the multichannel audio amplification apparatus 1 according to this embodiment can be used in various operating situations according to the configuration of the A-type speaker group connected to the speaker terminal group TA or the B-type speaker group connected to the speaker terminal group TB on the one hand and according to whether the A-type speaker group and the B-type speaker group are arranged in the same or different zones. FIGS. 2 to 5 are diagrams for explaining the typical operating situations of the multichannel audio amplification apparatus 1. FIGS. 2(*a*) to 5(*a*) are diagrams for explaining the arrangement of the speakers and the reproduction zones, and FIGS. 2(*b*) to 5(*b*) diagrams for explaining the condition of the multichannel audio amplification apparatus 1 and the connection with the speaker groups. Incidentally, in FIGS. 2 to 5, the description of a part of the configuration of the multichannel audio amplification apparatus 1 shown in FIG. 1 and the connection lines to each speaker is omitted. Also, the microphone connected to the Mic terminal of the speaker identification circuit 8 is arranged in zone 1 and measures the multichannel sound and the test noise supplied to the listener U.

FIG. 2 shows a case in which the A-type speaker group of the 5.1-channel configuration is connected to the multichannel audio amplification apparatus 1 and arranged in zone 1, while the B-type speaker group is not connected to the multichannel audio amplification apparatus 1. Zone 1 has arranged therein the front left speaker Lsp, the front right speaker Rsp, the front center speaker Csp, the surround left speaker SLsp, the surround right speaker SRsp and the subwoofer Sub of the A-type speaker group. The terminal l of the speaker terminal group TA is connected with the front left speaker Lsp, the terminal r with the front right speaker Rsp, the terminal c with the front center speaker Csp, the terminal sl with the surround left speaker SLsp and the terminal sr with the surround right speaker SRsp. The terminals sbl/bl and sbr/br, on the other hand, are connected with neither the speakers of the A-type speaker group nor the speakers of the B-type speaker group. In this case, the listener U usually turns on "Speaker A" by through the switch of the operating circuit 6 to use only the A-type speaker group.

In FIG. 2, upon operation of the operating circuit 6 to turn on "Speaker A", the DSP 10 adjusts the levels of the surround back left data SBL and the surround back right data SBR output from the decode circuit 11 by multiplying them by a predetermined coefficient in the multiplier arranged in the mix processing circuit 12. After that, the products are added to the surround left data SL and the surround right data SR, respectively, by the adder. In the case of FIG. 2, the coefficients k01 to k13 are appropriately set to the proper correlation value except that the coefficient k14 is zero. Also, the switches SW11 to SW14 included in the mix processing circuit 12 are all turned off, and no output signal is output to the terminals sbl/bl and sbr/br doubling as the speaker terminal group TB for connecting the B-type speaker group.

Figure 3:
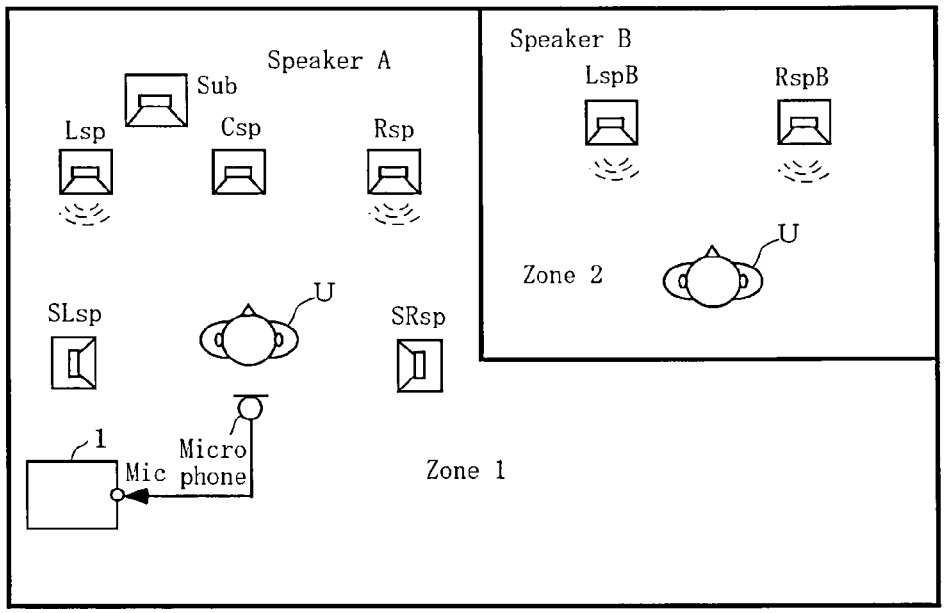
FIG. 3 is a diagram for explaining another typical operation of the multichannel audio amplification apparatus (First Embodiment)
Figure 3:
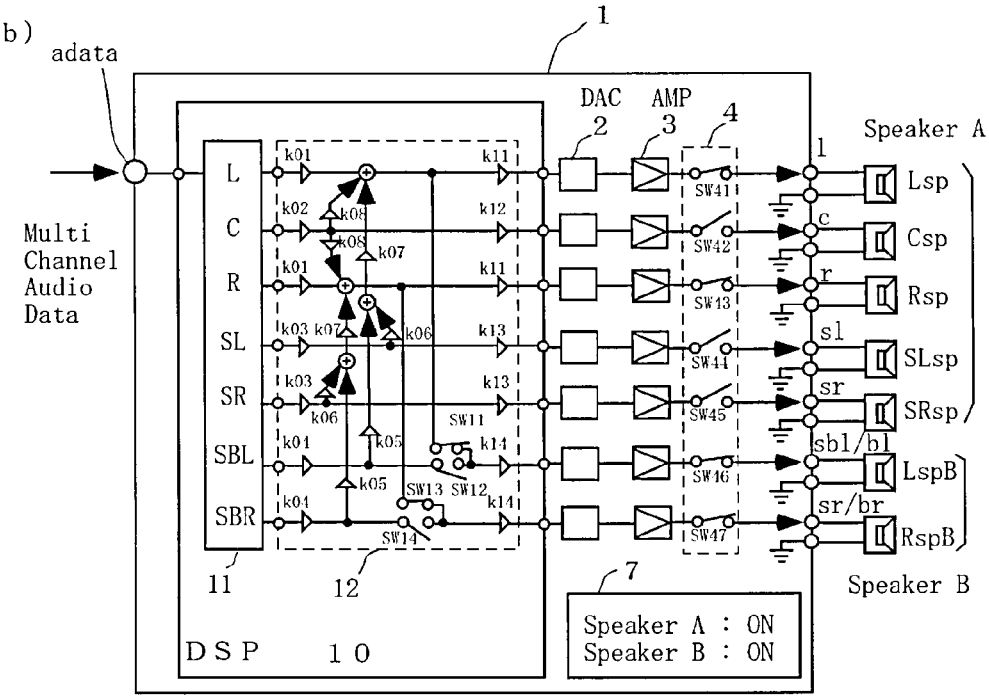

FIG. 3 shows a case in which the A-type speaker group of the 5.1-channel configuration is connected to the multichannel audio amplification apparatus 1 and arranged in zone 1, while the B-type speaker group is connected to the multichannel audio amplification apparatus 1 and arranged in zone 2. Zone 1 has arranged therein the front left speaker Lsp, the front right speaker Rsp, the front center speaker Csp, the surround left speaker SLsp, the surround right speaker SRsp and the subwoofer Sub of the A-type speaker group. Zone 2, on the other hand, has arranged therein the front left speaker LspB and the front right speaker RspB of the B-type speaker group. The terminal l of the speaker terminal group TA is connected with the front left speaker Lsp, the terminal r with the front right speaker Rsp, the terminal c with the front center speaker Csp, the terminal sl with the surround left speaker SLsp and the terminal sr with the surround right speaker SRsp. On the other hand, the terminal sbl/bl is connected with the front left speaker LspB of the B-type speaker group, and the terminal sbr/br with the front right speaker RspB of the B-type speaker group. In this case, the listener U normally uses the A-type speaker group by operating the switch of the operating circuit 6 to turn on "Speaker A" and/or uses the B-type speaker group by turning on "Speaker B". In other words, "Speaker A or B" and "Speaker A+B" are operable.

In the case of FIG. 3, assume that only "Speaker B" is on or "Speaker A+B" is operated by the operating circuit 6. The DSP 10 adjusts the level by multiplying the front center data C, the surround left data SL and the surround back left data SBL output from the decode circuit 11, by a predetermined coefficient in the multiplier included in the mix processing circuit 12, and then the products are added to the front left data L by the adder. Also, the front center data C, the surround right data SR and the surround back right data SBR are multiplied by a predetermined coefficient in the multiplier included in the mix processing circuit 12 thereby to adjust each level, after which the respective products are added to the front right data R by the adder. In the case of FIG. 3, the coefficients k01 to k11 are appropriately set to the proper value of correlation except that the coefficients k12, k13 and k14 are zero. Also, the switches SW11 and SW13 included in the mix processing circuit 12 are turned on, while the switches SW12 and SW14 are turned off. As a result, the stereo audio signal obtained from the multichannel audio signal subjected to the mixing process is output to the terminals 1 and r included in the terminal group TA for connecting the A-type speaker group and the terminals sbl/bl and sbr/br for connecting the B-type speaker group. On the other hand, no output signal is output to the terminals c, sl and sr.

Figure 4:
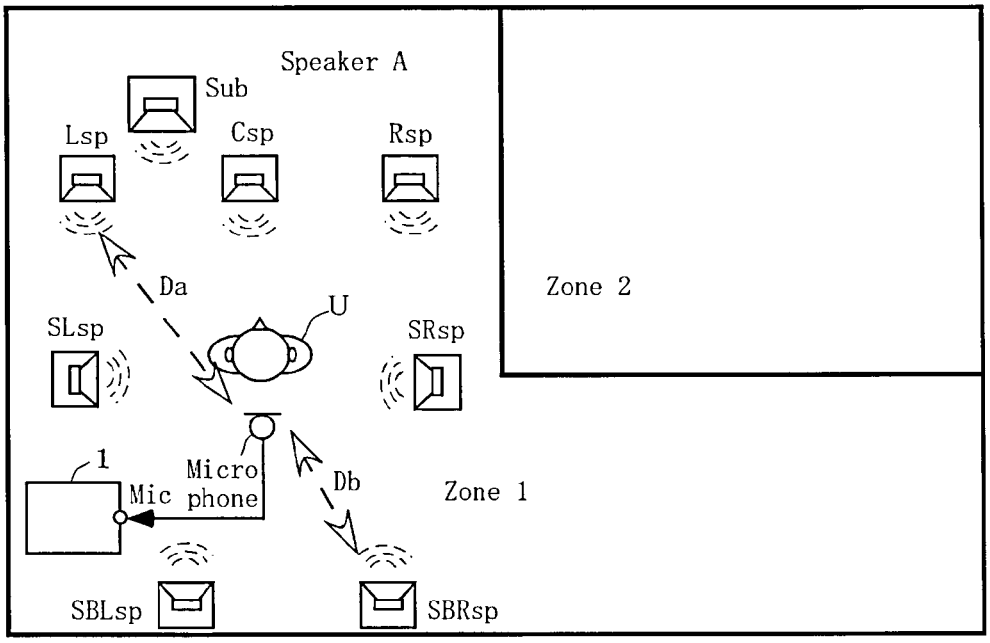
FIG. 4 is a diagram for explaining still another typical operation of the multichannel audio amplification apparatus (First Embodiment)
Figure 4:
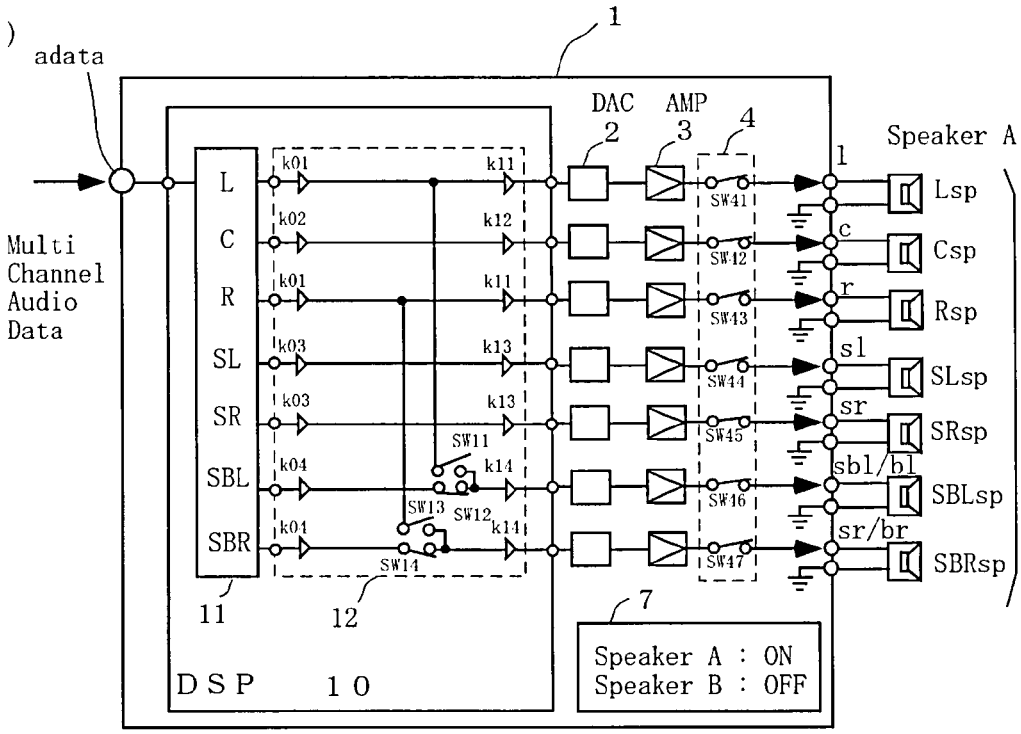

FIG. 4 shows a case in which the A-type speaker group of the 7.1-channel configuration is connected to the multichannel audio amplification apparatus 1 and arranged in zone 1, while the B-type speaker group is not connected to the multichannel audio amplification apparatus 1. Zone 1 has arranged therein the front left speaker Lsp, the front right speaker Rsp, the front center speaker Csp, the surround left speaker SLsp, the surround right speaker SRsp, the surround back left speaker SBLsp, the surround back right speaker SBRsp and the subwoofer Sub of the A-type speaker group. The terminal 1 of the speaker terminal group TA is connected with the front left speaker Lsp, the terminal r with the front right speaker Rsp, the terminal c with the front center speaker Csp, the terminal sl with the surround left speaker SLsp, and the terminal sr with the surround right speaker SRsp. Also, the terminal sbl/bl is connected with the surround back left speaker SBLsp of the A-type speaker group and the terminal sbr/br with the surround back right speaker SBRsp. In this case, the listener U normally uses the A-type speaker group by operating the switch of the operating circuit 6 to turn on "Speaker A". Since the terminals sbl/bl and sbr/br are connected with the speakers which can be considered to replace the B-type speaker group, however, the operation to turn on "Speaker B" is also preferably possible.

In the case of FIG. 4, upon operation of the operating circuit 6 to turn on "Speaker A", the DSP 10 operates in such a manner that the front left data L, the front center data C, the front right data R, the surround left data SL, the surround back left data SBL and the surround back right data SBR output from the decode circuit 11 are multiplied by a predetermined coefficient in the multiplier arranged in the mix processing circuit 12. After thus adjusting each level, the products are output as they are without the mixing process. In the case of FIG. 4, the coefficients k01 to k04, k11 to k14 are appropriately set to the proper correlation value. Also, the switches SW11 and SW13 included in the mix processing circuit 12 are turned off, and the switches SW12 and SW14 are turned on. Therefore, the surround back left signal and the surround back right signal are output but the stereo audio signal obtained from the multichannel audio signal subjected to the mixing process are not output to those terminals sbl/bl and sbr/br included in the terminal group TA for connecting the A-type speaker group which are used also to connect the B-type speaker group.

Figure 5:
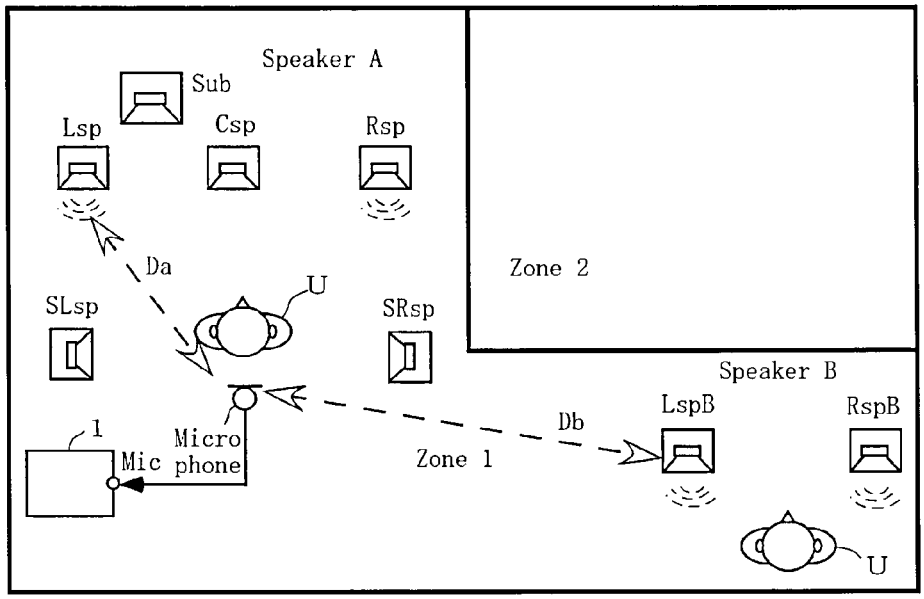
FIG. 5 is a diagram for explaining still further another typical operation of the multichannel audio amplification apparatus (First Embodiment)
Figure 5:
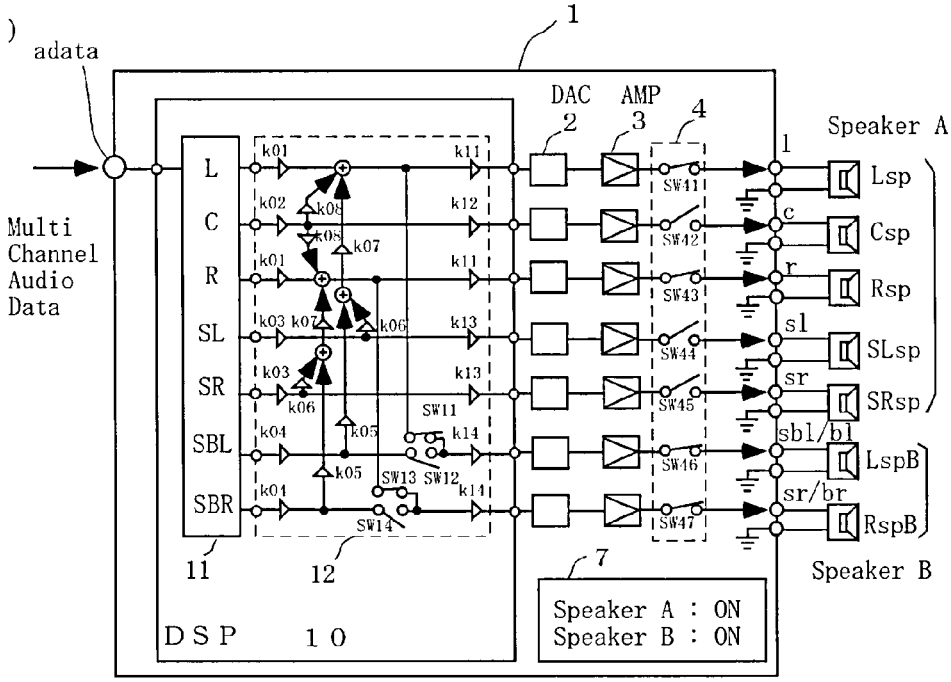

FIG. 5 shows a case in which the A-type speaker group of 5.1 channels is connected to the multichannel audio amplification apparatus 1 and arranged in zone 1, while the B-type speaker group is connected to the multichannel audio amplification apparatus 1 and arranged also in zone 1. Zone 1 has arranged therein the front left speaker Lsp, the front right speaker Rsp, the front center speaker Csp, the surround left speaker SLsp, the surround right speaker SRsp and the subwoofer Sub of the A-type speaker group. The front left speaker LspB and the front right speaker RspB of the B-type speaker group are arranged in spaced relation with the position where the A-type speaker group is arranged in zone 1. The terminal 1 of the speaker terminal group TA is connected with the front left speaker Lsp, the terminal r with the front right speaker Rsp, the terminal c with the front center speaker Csp, the terminal sl with the surround left speaker SLsp and the terminal sr with the surround right speaker SRsp. On the other hand, the terminal sbl/bl is connected with the front left speaker LspB of the B-type speaker group, and the terminal sbr/br with the front right speaker RspB of the B-type speaker group. In this case, the listener U normally uses the A-type speaker group by operating the switch of the operating circuit 6 to turn on "Speaker A" and/or uses the B-type speaker group by turning on "Speaker B". In other words, "Speaker A or B" and "Speaker A+B" are operable.

In the case of FIG. 5, assume that only "Speaker B" is on or "Speaker A+B" is operated by the operating circuit 6. The DSP 10 operates in similar manner to the case of FIG. 3. Thus, the stereo audio signal obtained from the multichannel audio signal subjected to the mixing process is output to the terminals 1, r included in the terminal group TA for connecting the A-type speaker group and the terminals sbl/bl, sbr/br for connecting the B-type speaker group. On the other hand, no output signal is output to the terminals c, sl, sr.

Figure 6:
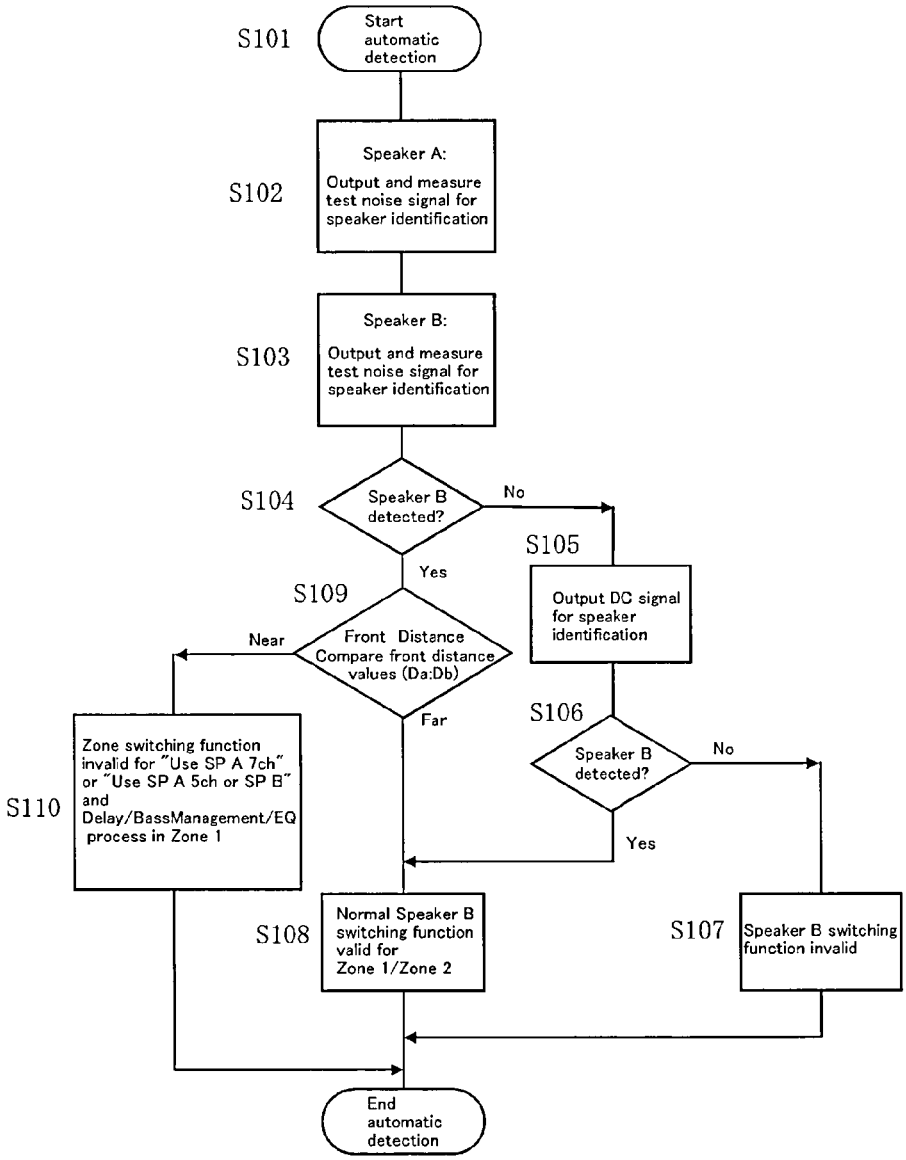
FIG. 6 is a flowchart for explaining operation of a CPU of the multichannel audio amplification apparatus to automatically detect presence or absence of a speaker connected to speaker terminal groups TA and TB (First Embodiment)

FIG. 6 is a flowchart for explaining the operation in which the CPU 5 for controlling the multichannel audio amplification apparatus 1 according to this embodiment automatically detects the presence or absence of the speaker connected to the speaker terminal groups TA and TB and the presence or absence of the speaker connected to the speaker terminal group TB in accordance with the operating situations typically shown in FIGS. 2 to 5. This operation of automatic detection is started by the listener U operating the operating circuit 6 of the multichannel audio amplification apparatus 1 and activating the speaker identification circuit 8 to identify the speaker (S101).

The CPU 5 outputs the test noise signal by operating the first test signal output circuit 13 built in the DSP 10, and through the speaker identification circuit 8 connected with the microphone, detects whether the speakers are connected or not to the terminal 1, the terminal r, the terminal c, the terminal sl, the terminal sr, the terminal sbl/bl and the terminal sbr/br of the speaker terminal group TA (and the shared speaker terminal group B) (S102, S103). As explained above, in a case where the first detection signal correlated with the test noise signal is not detected, the CPU 5 determines that no speaker is connected. Upon detection by the speaker identification circuit 8 that the speakers are connected, on the other hand, the delay time derived from the spatial distance from the microphone and the reproduction level are measured for each of the speakers thus connected.

Next, the CPU 5 determines whether the speakers are connected to any of the speaker terminals of the speaker terminal group TB, i.e. the speaker terminals sbl/bl and sbr/br (S104). In a case where the speaker identification circuit 8 connected with the microphone determines that no speaker is connected to the speaker terminal group TB (NO in step S104), as shown in FIG. 2, for example, two cases prevail. In one case, the speakers are actually connected to the speaker terminals sbl/bl and sbr/br, as shown in FIG. 2. In the other case, as shown in FIG. 3, in spite of the fact that the B-type speaker group is connected to the speaker terminals sbl/bl and sbr/br, the microphone connected to the speaker identification circuit 8 is arranged in zone 1, while the B-type speaker group is arranged in zone 2 acoustically distant from zone 1, with the result that the speaker identification circuit 8 cannot detect the connection of the B-type speaker group. The CPU 5, therefore, activates the connection detecting circuit 9 for outputting a fine DC voltage and detects whether the speaker is connected or not to the speaker terminal group TB (S105).

In a case where the result of detection by the connection detecting circuit 9 shows that no speaker is connected to the speaker terminal group TB (NO in step S106), the CPU 5 invalidates the operation of "Speaker B setting" or the operation for using the B-type speaker group (including the operation of turning on "Speaker B", the operation of selecting "Speaker A or B"/"Speaker A+B" and the operation making the zone 1 and zone 2 switchable) in the set-up menu (S107). In the operating situation shown in FIG. 2, for example, an attempt to select the B-type speaker group not connected would not result in the erroneous setting of "Speaker B", thereby preventing misrecognition of "a malfunction of the multichannel audio amplification apparatus 1". Also, in this case, the CPU 5 controls the DSP 10 and the selective output circuit 4 so that no output signal is output to the speaker terminals of the speaker terminal group TB.

Also, in a case where the detection result of the connection detecting circuit 9 shows that the speakers are connected to the speaker terminal group TB (YES in step S106), the CPU 5 determines that the A-type speaker group and the B-type speaker group are arranged in different zones, and validates the operation of "Speaker B setting", the operation for using the B-type speaker group (including the operation of turning on "Speaker B", the operation of selecting "Speaker A or B"/"Speaker A+B" and the operation making zone 1 and zone 2 switchable) in the set-up menu (S108). Specifically, in a case where the operating situation shown in FIG. 3 prevails, the listener U uses by switching the A-type speaker group arranged in zone 1 or the B-type speaker group arranged in zone 2 ("Speaker A or B"), or a first listener U and a second listener U can use zones 1 and 2, respectively, simultaneously ("Speaker A+B"). Incidentally, in a case where "Speaker B" is on or "Speaker A+B" prevails, the multichannel audio amplification apparatus 1 outputs the stereo signal obtained from the multichannel audio signal subjected to the mixing process, so that the stereo sound is reproduced in zone 2, and the reproduction is prevented in which the sound contained in other than the front left data L and the front right data R drop off. In a case where only "Speaker A" is turned on, the 5.1-channel surround sound field can of course be reproduced using all the A-type speakers arranged in zone 1.

In a case where the speaker identification circuit 8 connected with the microphone determines that the speakers are connected to any speaker terminals of the speaker terminal group TB, i.e. the speaker terminals sbl/bl and sbr/br (YES in step S104), then the CPU 5 determines that the A-type speaker group and the B-type speaker group are arranged in the same zone, and compares the spatial distance Da between the A-type speaker group and the to-be-measured microphone with the spatial distance Db between the B-type speaker group and the to-be-measured microphone using the measured delay time of the A-type speaker group and the measured delay time of the B-type speaker group (S109). Specifically, the spatial distance between the speaker connected to the terminal 1 of the speaker terminal group TA and the microphone is compared with the spatial distance Db between the speaker connected to the terminal sbl/bl of the speaker terminal group TB and the microphone, and in a case where the ratio Db/Da is less than a predetermined value, as shown in FIG. 4, for example, the CPU 5 determines that the A-type speaker group connected to the speaker terminal group TA and the speaker group connected to the speaker terminal group TB are arranged in the same zone in proximity to each other (NEAR in step S109). Thus, the speaker group connected to speaker terminals sbl/bl and sbr/br is determined as the surround back left speaker SBLsp and the surround back right speaker SBRsp or the front left speaker LspB and the front right speaker RspB of the B-type speaker group, and the operation of "Speaker B setting" or the operation using the B-type speaker group (including the operation of turning on "Speaker B" and the operation of selecting "Speaker A or B"/"Speaker A+B") in the set-up menu is validated, while simultaneously invalidating the operation of making zone 1 and zone 2 switchable (S110).

On the other hand, the CPU 5 compares the spatial distance Da between the A-type speaker group and the to-be-measured microphone with the spatial distance Db between the B-type speaker group and the to-be-measured microphone (S109), and in a case where the ratio Db/Da is not less than a predetermined value, determines that the A-type speaker group connected to the speaker terminal group TA and the speaker group connected to the speaker terminal group TB, though arranged in the same zone, are distant from each other (FAR in S109). In this case, the situation is substantially the same as if the A-type speaker group and the B-type speaker group are arranged in different zones. Therefore, the operation of "Speaker B setting" or the operation for using the B-type speaker group (including the operation of turning on "Speaker B" and the operation of selecting "Speaker A or B"/"Speaker A+B") or the operation of making zone 1 and zone 2 switchable in the set-up menu is validated (S108).

By detecting the speakers connected to the speaker terminal groups TA and TB in this way, the CPU 5 validates or invalidates the operation of "Speaker B setting" or the operation for using the B-type speaker group (including the operation of turning on "Speaker B" and the operation of selecting "Speaker A or B"/"Speaker A+B") and the operation of making zone 1 and zone 2 switchable in the set-up menu, thereby finishing the operation of automatic detection (S110).

Figure 7:
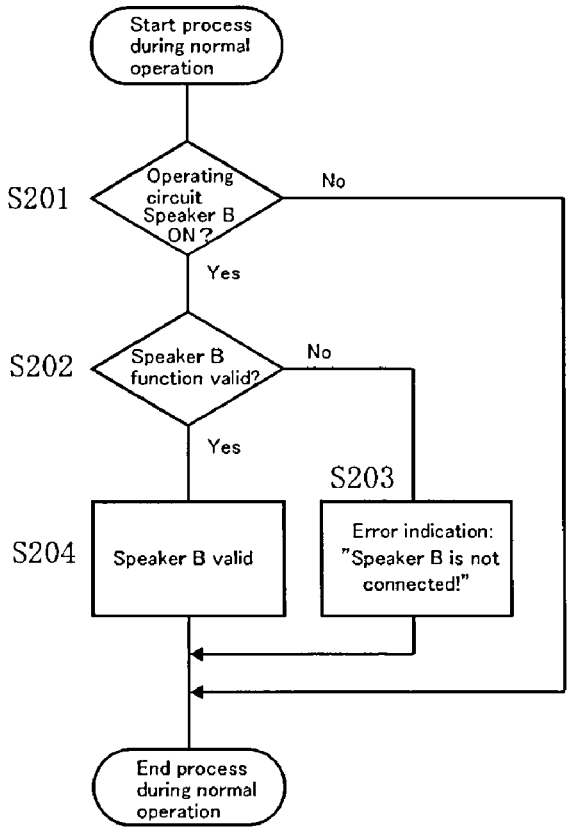
FIG. 7 is a flowchart for explaining operation of the CPU during normal operation of the multichannel audio amplification apparatus (First Embodiment).

FIG. 7 is a flowchart for explaining the operation of the CPU 5 in a case where the listener U has carried out the operation of turning on "Speaker B" by the operating circuit 6 of the multichannel audio amplification apparatus 1 (YES in S201), for example, during the normal operation of the multichannel audio amplification apparatus 1 according to this embodiment, i.e. during the normal operation after finishing the operation of the CPU 5 of the multichannel audio amplification apparatus 1 to automatically detect the presence or absence of the speakers already connected to the speaker terminal groups TA and TB and the presence or absence of the speakers connected to the speaker terminal group TB.

In a case where the result of automatic detection of the speaker connection shows that the operation for using the B-type speaker group is invalid (NO in S202), the CPU 5 displays an error "Speaker B is not Connected!" (B-type speaker group is not connected) on the display circuit 7 (S203), the B-type speaker group being not connected to the speaker terminals sbl/bl, sbr/br. Specifically, in a case where the operating situation shown in FIG. 2 prevails, an attempt, if any, of the listener U to turn on "Speaker B" is not accepted by the multichannel audio amplification apparatus 1, and the notice "Speaker B setting invalid" is displayed through the display circuit 7 thereby indicating to the listener U that the operation for using the B-type speaker group is impossible.

In a case where the result of automatic detection of speaker connection shows that the operation for using the B-type speaker group is valid (YES in S202), on the other hand, the CPU 5 permits the operation for using the B-type speaker group (S204), the B-type speaker group being connected with the speaker terminals sbl/bl, sbr/br. Specifically, in a case where the operating situation shown in FIG. 3 prevails, the mix processing circuit 12 of the DSP 10 outputs the stereo audio signal obtained from the multichannel audio signal subjected to the mixing process, which can be reproduced by the front left speaker LspB and the front right speaker RspB of the B-type speaker group arranged in zone 2.

As described above, the listener U, in performing the operation of the multichannel audio amplification apparatus 1 according to this embodiment, makes no erroneous operation or setting and has a slim chance of misrecognition of a malfunction even in a case where the B-type speaker group constituting one of the two types of speaker groups, i.e. the A and B types cannot be connected with the surround speaker for reproducing only the surround sound.

Incidentally, the mixing process executed by the mix processing circuit 12 of the DSP 10 is not limited to the case shown in FIGS. 2 to 5 of this embodiment. In the downmixing method for reproducing the multichannel sound output from the decode circuit 11 of the DSP 10 as a stereo audio signal, the virtual surround process may be executed in which the virtual localization of the surround audio signal is carried out by the filter circuit built in the DSP 10 based on the head related transfer function (HRTF) and the result is added to the front audio signal. As another alternative, the bass signal LFE may be added.

In a case where the multichannel sound output from the decode circuit 11 of the DSP 10 is what is called 5.1 channel, the speaker terminal group TA of the multichannel audio amplification apparatus 1 may have speaker terminals for connecting the speakers of a maximum of 6 channels in total, and the speaker terminal group TB may double as a part of the speaker terminal group TA as in the aforementioned embodiments or may be a speaker terminal group separate from the speaker terminal group TA.

Further, although the select circuit 4 of the multichannel audio amplification apparatus 1 according to this embodiment is configured of a plurality of switch relays to turn on/off the output of the amplifier circuits 3 corresponding to the respective speaker terminals, the invention is not limited to the shown case. As an alternative, the output of one amplifier circuit may be connected to a plurality of speaker terminals in parallel. What is required is that the output of a predetermined amplifier is output to an arbitrary speaker terminal in accordance with the configuration of the multichannel sound output from the decode circuit 11 of the DSP 10 and the mixing process executed by the mix processing circuit 12.

The multichannel audio amplification apparatus according to the invention is not limited to the embodiments described above, but is also applicable to a multichannel audio amplification apparatus such as an AV receiver for transmitting the multichannel audio signal in the format of MPEG-2/AAC, and a disk reproduction device, including an amplifier connected with two speaker groups of A and B types.

What is claimed is:

1. A multichannel audio amplification apparatus comprising a speaker terminal group TA for connecting an A-type speaker group including at least one surround speaker for reproducing only a surround sound included in a multichannel sound and a speaker terminal group TB for connecting a B-type speaker group including no surround speaker;

the multichannel audio amplification apparatus further comprising:

an audio output circuit for outputting one of a multichannel audio signal and a stereo audio signal obtained by the multichannel audio signal subjected to a mixing process;

an amplifier circuit including a plurality of amplifiers for amplifying one of the multichannel audio signal and the stereo audio signal;

a selective output circuit for selectively outputting one of the amplified multichannel audio signal and the amplified stereo audio signal by switching to an arbitrary speaker terminal out of the speaker terminal groups TA and TB;

a speaker detection circuit for detecting whether or not a speaker is connected to an arbitrary speaker terminal out of the speaker terminal groups TA and TB;

a control circuit for controlling the audio output circuit, the amplifier circuit, the selective output circuit and the speaker detection circuit; and an operating circuit and a display circuit connected to the control circuit; wherein in a case where the speaker detection circuit detects that no speaker is connected to one of the speaker terminals of the speaker terminal group TB, the control circuit controls the audio output circuit and the selective output circuit in such a manner that output signals of the plurality of amplifiers are output to none of the speaker terminals of the speaker terminal group TB, and controls the display circuit to display that an operation for using the B-type speaker group by the operating circuit is impossible, while in a case where the speaker detection circuit detects that the speaker is connected to one of the speaker terminals of the speaker terminal group TB, the control circuit controls the display circuit to display that the operation for using the B-type speaker group by the operating circuit is possible.

2. The multichannel audio amplification apparatus according to claim 1, wherein the speaker detection circuit includes:

a first detection circuit having a first test signal output circuit for selectively outputting a noise signal to an arbitrary speaker terminal out of the speaker terminal groups TA and TB, and a mic amplifier connected with a microphone for converting a sound wave in an installation zone into an electrical signal and outputting a first detection signal, the first detection circuit being adapted to detect that the speaker is connected to an arbitrary speaker terminal out of the speaker terminal groups TA and TB upon detection of the first detection signal correlated with the noise signal; and a second detection circuit having a second test signal output circuit for selectively outputting a fine DC signal to an arbitrary speaker terminal of the speaker terminal group TB and an offset detection circuit for detecting a DC voltage of the speaker terminal to convert into a second detection signal, the second detection circuit being adapted to detect that the speaker is connected to an arbitrary speaker terminal of the speaker terminal group TB upon detection of the second detection signal correlated with the fine DC signal.

3. The multichannel audio amplification apparatus according to claim 2, wherein in a case where the speaker detection circuit detects that the speaker is connected to one of the speaker terminals of the speaker terminal group TB and the operating circuit is operated to use only the A-type speaker group, the control circuit controls the audio output circuit to output the multichannel audio signal and controls the selective output circuit to output the output signals from the plurality of amplifiers only to the speaker terminals of the speaker terminal group TA.

4. The multichannel audio amplification apparatus according to claim 2, wherein in a case where the speaker detection circuit detects that the speaker is connected to one of the speaker terminals of the speaker terminal group TB and the operating circuit is operated to use only the B-type speaker group, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal group TB.

5. The multichannel audio amplification apparatus according to claim 2, wherein in a case where the speaker detection circuit detects that the speaker is connected to one of the speaker terminals of the speaker terminal group TB and the operating circuit is operated to use the A-type speaker group and the B-type speaker group simultaneously, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal groups TA and TB.

6. The multichannel audio amplification apparatus according to claim 2, wherein in a case where the first detection circuit of the speaker detection circuit does not detect that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in different zones, and controls the audio output circuit to output the stereo audio signal obtained from the multichannel audio signal subjected to the mixing process and controls the selective output circuit to output the output signals from the plurality of amplifiers to the speaker terminals of the speaker terminal group TB.

7. The multichannel audio amplification apparatus according to claim 2, wherein in a case where the first detection circuit of the speaker detection circuit detects that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in an identical zone, and controls the audio output circuit, the amplifier circuit, the selective output circuit, the operating circuit and the display circuit, and in a case where the control circuit determines that a ratio Db/Da, where Da is a spatial distance between the speaker terminal group TA detected by the first detection circuit and the microphone and Db is a spatial distance between the speaker terminal group TB detected by the first detection circuit and the microphone, is not less than a predetermined value, the control circuit controls the audio output circuit to output the stereo audio signal obtained from the multichannel audio signal subjected to the mixing process and controls the selective output circuit to output the output signals from the plurality of amplifiers to the speaker terminals of the speaker terminal group TB.

8. The multichannel audio amplification apparatus according to claim 2, wherein the speaker terminal group TB for connecting the B-type speaker group is set to double as a surround speaker terminal group for connecting the at least one surround speaker in the A-type speaker group included in the speaker terminal group TA.

9. The multichannel audio amplification apparatus according to claim 8, wherein in a case where the speaker detection circuit detects that the speaker is connected to one of the speaker terminals of the speaker terminal group TB and the operating circuit is operated to use only the A-type speaker group, the control circuit controls the audio output circuit to output the multichannel audio signal, and controls the selective output circuit to output the output signals from the plurality of amplifiers only to the speaker terminals of the speaker terminal group TA.

10. The multichannel audio amplification apparatus according to claim 8, wherein in a case where the speaker detection circuit detects that the speaker is connected to one of the speaker terminals of the speaker terminal group TB and the operating circuit is operated to use only the B-type speaker group, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal group TB.

11. The multichannel audio amplification apparatus according to claim 8, wherein in a case where the speaker detection circuit detects that the speaker is connected to one of the speaker terminals of the speaker terminal group TB and the operating circuit is operated to use the A-type speaker group and the B-type speaker group simultaneously, the control circuit controls the audio output circuit to output the stereo audio signal obtained from the multichannel audio signal subjected to the mixing process, and controls the selective output circuit to output the output signals from the plurality of amplifiers to the speaker terminals of the speaker terminal groups TA and TB.

12. The multichannel audio amplification apparatus according to claim 8, wherein in a case where the first detection circuit of the speaker detection circuit does not detect that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in different zones, and controls the audio output circuit to output the stereo audio signal obtained from the multichannel audio signal subjected to the mixing process and controls the selective output circuit to output the output signals from the plurality of amplifiers to the speaker terminals of the speaker terminal group TB.

13. The multichannel audio amplification apparatus according to claim 8, wherein in a case where the first detection circuit of the speaker detection circuit detects that the B-type speaker group is connected to the speaker terminal group TB, the second detection circuit detects that the B-type speaker group is connected to the speaker terminal group TB, and the operating circuit is operated to use the B-type speaker group, the control circuit determines that the A-type speaker group and the B-type speaker group are arranged in an identical zone, and controls the audio output circuit, the amplifier circuit, the selective output circuit, the operating circuit and the display circuit, and in a case where the control circuit determines that a ratio Db/Da, where Da is a spatial distance between the speaker terminal group TA detected by the first detection circuit and the microphone and Db is a spatial distance Db between the speaker terminal group TB detected by the first detection circuit and the microphone, is not less than a predetermined value, the control circuit controls the audio output circuit to output the stereo audio signal obtained from the multichannel audio signal subjected to the mixing process and controls the selective output circuit to output the output signals from the plurality of amplifiers to the speaker terminals of the speaker terminal group TB.

* * * * *